US007682136B2

(12) United States Patent
Donoho, II et al.

(10) Patent No.: US 7,682,136 B2
(45) Date of Patent: Mar. 23, 2010

(54) MULTIPLE PUMP HOUSING

(75) Inventors: Michael R. Donoho, II, Edelstein, IL (US); Christopher M. Elliott, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 1738 days.

(21) Appl. No.: 10/746,500

(22) Filed: Dec. 29, 2003

(65) Prior Publication Data

US 2004/0191092 A1 Sep. 30, 2004

(51) Int. Cl.
*F04B 9/14* (2006.01)

(52) U.S. Cl. ..... 417/374

(58) Field of Classification Search ..... 417/426, 417/374, 2, 3, 9, 417, 410.4; 418/9, 5, 15; 123/196 R, 196 S, 41.01, 41.05; 184/6.5, 184/104.2, 6.28, 27.2
See application file for complete search history.

(56) References Cited

U.S. PATENT DOCUMENTS 2,562,363 A * 7/1951 Nixon ..... 91/473
2,838,039 A 6/1958 Smith et al.
3,184,155 A * 5/1965 Crooks William R ..... 417/338
3,481,532 A * 12/1969 Fraser Grover D ..... 418/9
3,961,562 A * 6/1976 Kersten et al. ..... 91/492
4,105,374 A * 8/1978 Scharf ..... 417/415
4,358,254 A * 11/1982 Hannibal ..... 417/419
4,458,644 A 7/1984 Papst
4,531,485 A * 7/1985 Murther ..... 123/196 S
4,642,604 A 2/1987 Glesmann et al.
4,644,207 A 2/1987 Catterfeld et al.
4,741,304 A 5/1988 Martin et al.
4,941,801 A 7/1990 Takakura
5,063,895 A 11/1991 Ampferer
5,085,181 A 2/1992 Feuling
5,118,258 A * 6/1992 Martin ..... 417/3
5,121,720 A 6/1992 Roberts
5,168,845 A 12/1992 Peaker
5,247,914 A 9/1993 Imai et al.
5,378,128 A * 1/1995 Yanagisawa ..... 418/9
5,454,697 A * 10/1995 Nakanishi ..... 417/423.3
5,511,522 A 4/1996 Tran
5,511,957 A * 4/1996 Tuckey et al. ..... 417/313
5,567,134 A * 10/1996 Inoue ..... 417/490
5,743,231 A 4/1998 Reinosa
5,765,521 A 6/1998 Stützle et al.
5,829,957 A * 11/1998 Ozaki et al. ..... 417/304
5,845,756 A 12/1998 Dairokuno et al.
5,884,601 A 3/1999 Robinson
5,901,811 A 5/1999 Samples et al.
6,113,368 A 9/2000 Hofmann
6,321,893 B1 * 11/2001 Muhlert et al. ..... 192/99 S
6,615,786 B2 * 9/2003 Mori et al. ..... 123/179.31
6,739,305 B2 * 5/2004 Takahara et al. ..... 123/196 R (Continued)

FOREIGN PATENT DOCUMENTS

JP 1063689 A * 9/1989

*Primary Examiner*—Devon C Kramer
*Assistant Examiner*—Alexander B Comley
(74) *Attorney, Agent, or Firm*—Finnegan, Henderson, Farabow, Garrett & Dunner

(57) ABSTRACT

A fluid delivery system includes a first pump having a first drive assembly, a second pump having a second drive assembly, and a pump housing. At least a portion of each of the first and second pumps are located in the housing.

32 Claims, 2 Drawing Sheets

U.S. PATENT DOCUMENTS 6,792,915 B2 * 9/2004 Rembold et al. ..... 123/446
2002/0125052 A1 * 9/2002 Naruse et al. ..... 180/53.8
2002/0139345 A1 * 10/2002 Takahara et al. ..... 123/196 R
2003/0230274 A1 * 12/2003 Williams et al. ..... 123/196 R
2004/0179962 A1 * 9/2004 Hopper ..... 417/426

* cited by examiner

MULTIPLE PUMP HOUSING

GOVERNMENT RIGHTS

This invention was made with Government support under the terms of Contract No. DE-FC04-2000AL67017 awarded by the U.S. Department of Energy. The Government may have certain rights in this invention.

TECHNICAL FIELD

This invention relates generally to fluid delivery systems, and more particularly, to housings for pumps.

BACKGROUND

Current multiple pump systems may rely on a single drive assembly to actuate more than one pumping assemblies in a housing. Driving multiple pumping assemblies with a single drive assembly, however, may require a great deal of force and may place significant torsional loads on the pumping assemblies. To compensate, current multiple pump systems may employ a large drive assembly. They may also require large, heavy, and expensive pumping assembly parts to transmit the torque generated by the drive assembly. These larger parts increase the overall size of current multiple pump systems. This can be a serious drawback, particularly if the system is to be located within the engine compartment of an internal combustion engine driven machine, or some other tightly constricted area.

In addition to the problems of size, weight, and cost, current single drive assembly multiple pump systems do not enable the user to vary the system's output easily. In such systems, a shaft of the pumping assembly may be directly coupled to the drive assembly shaft. With such a linkage, the amount of pumped working fluid increases and decreases with the speed of the drive assembly. However, the need for working fluid does not always directly correspond to the speed of the drive assembly. For instance, components may require working fluid before the drive assembly is started and after it has stopped. Because the drive assembly is not turning at either of these times, however, conventional systems do not supply the needed working fluid when required by the components.

The inability to regulate the amount of pumped working fluid may also result in an oversupply or an undersupply of working fluid to the drive assembly components. This could be problematic in that an undersupply of working fluid to the components could cause the drive assembly to overheat, while an oversupply of working fluid could result in a parasitic loss of power by the drive assembly.

Moreover, multiple drive assembly multiple pump systems may employ multiple housings to enclose the pumps. Similar to the single drive assembly multiple pump systems discussed, however, these multiple housing designs may also increase the size of the overall system. In applications similar to those mentioned above, including two separate housings may not even be possible due to space constraints.

One example of a conventional multiple pump system is disclosed in U.S. Pat. No. 3,961,562 to Kersten et al. This system uses a single drive assembly to actuate the pumping assemblies within a pump housing. This arrangement may result in expensive, oversized shafts, bearings, couplings, and other elements to transmit torque from the single drive assembly to the multiple pumping assemblies. In addition, due to the larger parts required, this design may not be suitable for many applications having tight space constraints. Finally, this arrangement does not allow for variability in the amount of working fluid supplied.

The present disclosure provides a multiple pump housing that avoids some or all of the aforesaid shortcomings in the prior art.

SUMMARY OF THE INVENTION

In accordance with one aspect of the present disclosure, a fluid delivery system includes a first pump having a first drive assembly, a second pump having a second drive assembly, and a pump housing. At least a portion of each of the first and second pumps is located in the housing.

According to another aspect of the present disclosure, a fluid delivery system includes a first pump driven by an electric motor, a second pump driven by an internal combustion engine, a pump housing, and a dividing wall. At least a portion of each of the first and second pumps is enclosed within the housing. The dividing wall separates the first pump from the second pump, and has a first side and a second side.

According to yet another aspect of the present disclosure, a method of supplying fluid includes driving a first pump with a first drive assembly, driving a second pump with a second drive assembly, and supplying working fluid from the first and second pumps. The working fluid is supplied by the first and second pumps out of a common housing.

It is to be understood that both the foregoing general description and the following detailed description are exemplary and explanatory only and are not restrictive of the invention as claimed.

DETAILED DESCRIPTION

Figure 1:
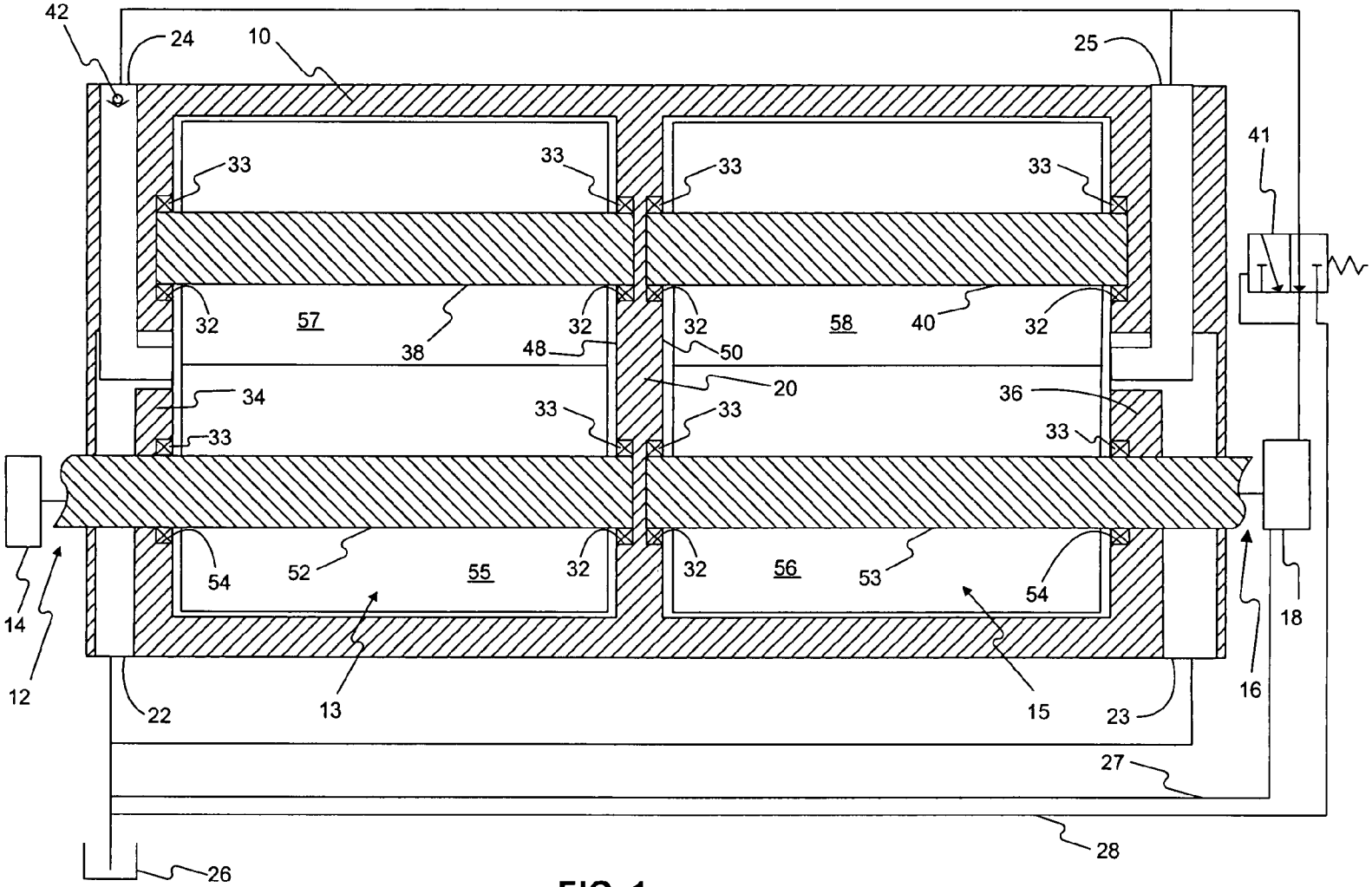
FIG. 1 is a partial cross section and partial diagrammatic view of a multiple pump housing according to an exemplary embodiment of the present disclosure.

FIG. 1 illustrates a pump housing 10 according to an embodiment of the present disclosure. A first pump 12 and a second pump 16 may be located within the pump housing 10. It is understood that both the first pump 12 and the second pump 16 may be the same style pump or different style pumps. It is further understood that the pumps 12, 16 could be displacement pumps of either the reciprocating power or rotary design. It is intended that the category rotary displacement pumps include both single and multiple rotor versions of valve, piston, flexible valve, lobe, gear, gerotor, circumferential piston and screw type pumps.

In addition, the pumps 12, 16 could be centrifugal pumps of the radial, mixed or axial flow design, or any other type of fluid delivery pumps not explicitly mentioned herein. Moreover, the housing 10 may be located in an engine compartment of a truck, tractor, bulldozer, or similar equipment, or any other motor or internal combustion engine powered machine.

It is understood that the term "pump" as used herein includes both a drive assembly and a pumping assembly. As such, the first pump 12 includes a first drive assembly 14 and a first pumping assembly 13, and the second pump 16 includes a second drive assembly 18 and a second pumping assembly 15. The pumping assemblies 13, 15 may include all the necessary components used to deliver fluid such as gears, impellers, shafts, bearings, and other components well known in the art. For example, FIG. 1 illustrates pumping assemblies 13, 15 for two gear style pumps 12, 16. As shown in FIG. 1, each pumping assembly 13, 15 may include two gears 55, 57 and 56, 58, a driving shaft 52, 53 and a driven shaft 38, 40 for displacing working fluid. As will be discussed, each of the shafts 52, 53, 38, 40 may be rotatably mounted.

The housing 10 of the present disclosure may enclose the entire first and second pump 12, 16, or only a portion of each pump 12, 16. As illustrated in FIG. 1, this portion may include, but is not limited to, the first and second pumping assemblies 13, 15. The housing 10 may be constructed of materials commonly used in pump housing construction. These materials may include, but are not limited to, steel, cast iron and aluminum.

The first drive assembly 14 may be an internal combustion engine, an electric motor, or any other type of assembly used to drive pumps. While not shown in FIG. 1, it is understood that the first drive assembly 14 may include conventional mechanical or electric components used in typical drive assemblies. Such components might include, but are not limited to, push rods, pistons, cams, gears, rotors, stators, and the like. The first drive assembly 14 may be coupled to a first driving shaft 52 of the first pumping assembly 13 using conventional couplings known in the art. Such couplings may include, but are not limited to, direct connections or indirect connections through, for example, a gear train.

Similar to the first drive assembly 14, the second drive assembly 18 may be an internal combustion engine, an electric motor, or any other type of assembly used to drive pumps. While not shown in FIG. 1, it is understood that the second drive assembly 18 may include conventional mechanical or electric components used in typical drive assemblies. Such components might include, but are not limited to, push rods, pistons, cams, gears, rotors, stators, or the like. The second drive assembly 18 may be rigidly coupled to a second driving shaft 53 of the second pumping assembly 15 using conventional couplings known in the art. It is understood that the first and second drive assemblies 14, 18 may be the same or different types of drive assemblies. For example, the first drive assembly 14 may be a drive assembly of the electric motor type. Similarly, the second drive assembly 18 may be a drive assembly of the internal combustion engine type. Alternatively, the first and second drive assemblies 14, 18 may both be drive assemblies of the electric motor type or of the internal combustion engine type.

In the instance that the drive assemblies 14, 18 are located outside of the pump housing 10, the housing 10 may include an appropriate number of shaft holes 54 for accepting the first and second driving shafts 52, 53. The number, size and location of these holes 54 may correspond to the number, size and type of driving assemblies 14, 18 used. It is understood that the driving shafts 52, 53 may be sealed within the shaft holes 54 in any conventional manner. It is further understood that shafts 52, 53 may be rotatably supported, for example, by a bearing assembly 33 located within each shaft hole 54. Bearing assemblies 33 will be discussed in greater detail later in this disclosure.

The pump housing 10 further includes at least one inlet and at least one outlet. It is understood that the present disclosure is not limited to a housing 10 having one inlet and one outlet, but, as shown in FIG. 1, may include a first and second inlet 22, 23 and a first and second outlet 24, 25, or as many inlets and outlets as there are pumping assemblies in the housing 10.

The first pump 12 may be fluidly connected to the first inlet 22 and first outlet 24 of the housing 10. In addition, the second pump 16 may be fluidly connected to the second inlet 23 and second outlet 25 of the housing 10. These fluid connections allow working fluid to pass from a working fluid supply, or sump 26, into the housing 10 to the first and second pumps 12, 16 through the inlets 22, 23. The connections also allow working fluid to pass from the pumps 12, 16 out of the housing 10 through the outlets 24, 25.

The sump 26 contains working fluid to be supplied to the pumps 12, 16, and can be an oil pan, a tank, or other commonly known container used to hold fluid. The sump 26 may be connected to the inlets 22, 23 of the housing 10 by hoses, tubing, pipes, or other connection apparatuses commonly used to transmit working fluid. Such apparatuses may be used to form an inlet manifold fluidly connecting each pump 12, 16 to the sump 26 separately, or alternatively, by way of a common header. The sump 26 may also be connected to the inlets 22, 23 of the housing 10 by passageways that are machined into, or are otherwise internal to the components to which the sump 26 is connected. For example, passageways connecting the sump 26 to the inlets 22, 23 may be machined into a block of an internal combustion engine that serves as the drive assembly 14, or 18. It is understood that these connections may also utilize gaskets, fittings, clamps or other commonly known connection structures to facilitate a proper fluid coupling.

The pumps 12, 16 of the housing 10 may be used to supply working fluid to an internal combustion engine or other mechanical, hydraulic or electrical device in need of pressurized fluid. As illustrated in FIG. 1, the device in need of working fluid may also be one of the drive assemblies 14, 18 used to drive one of the pumps 12, 16. For example, the second drive assembly 18 may be an internal combustion engine that receives working fluid from the pumps 12, 16. The working fluid may be oil, water, gasoline, or some other lubricant or fluid commonly known in the art of fluid delivery. The device in need of working fluid may be connected to the outlets 24, 25 of the housing 10 by hoses, tubing, pipes, or other connection apparatuses commonly used to transmit working fluid. Such apparatuses may be used to form an outlet manifold fluidly connecting the pumps 12, 16 to the device by way of a common header. The device in need of fluid may also be connected to the outlets 24, 25 of the housing 10 by passageways that are machined into, or are otherwise internal to the device. It is understood that these connections may also utilize gaskets, fittings, clamps or other commonly known connection structures to facilitate a proper fluid connection.

It is further understood that at least one over-pressure protection device 41 may be fluidly connected to the connection apparatuses mentioned above. The over-pressure protection device 41 may be a relief valve or other type of over-pressure protection valve commonly known in the art. In such an embodiment, the over-pressure protection device 41 may permit a proper flow of working fluid into the device in need of working fluid at a proper pressure, but may impede or prohibit flow into the device at an elevated pressure. For example, at an elevated pressure, the over-pressure protection device 41 may transmit at least a portion of working fluid back to the sump 26, or alternatively to the inlets 22, 23 of the housing 10, through an over-pressure line 28. It is understood that the over-pressure protection line 28 may include commonly known apparatuses or structures employed to facilitate the flow of working fluid. It is also understood that in an embodiment where the device in need of working fluid includes its own control mechanism, or other flow or pressure regulating device, an over-pressure protection device 41 of the type described above may not be necessary.

The second drive assembly 18, in the form of an internal combustion engine or other mechanical, hydraulic or electrical device in need of working fluid, may include an outlet line 27 through which working fluid may flow back to the sump 26 or may otherwise flow to the inlets 22, 23 of the housing 10. It is understood that outlet line 27 may include commonly known apparatuses or structures employed to facilitate the flow of working fluid.

Pump housing 10 may further include at least one valve assembly 42. In an embodiment of the present disclosure, the valve assembly 42 may be mounted to the first outlet 24, and may be a check valve or other type of one-way flow valve commonly known in the art. In such an embodiment, the valve assembly 42 may permit a proper flow of working fluid out of the first pump 12 while the pump is in operation, but may prohibit a reverse flow of working fluid through the first outlet 24.

In another embodiment of the present disclosure, the first drive assembly 14 may be a one-direction motor incapable of backward rotation. In such an embodiment, a valve assembly 42 may not be required to prohibit working fluid from flowing through the first outlet 24 and back into the first pump 12. In this embodiment, a valve assembly 42 may not be necessary.

In yet another embodiment of the present disclosure, at least one valve assembly 42 may be mounted outside of the pump housing 10 and within the connection apparatuses used to connect the device in need of working fluid to the first and second outlets 24, 25. As discussed earlier, these may include hoses, tubing, pipes, or other connection apparatuses or manifolds commonly used to transmit working fluid. They may also include passageways that are machined into, or are otherwise internal to the device.

In still another embodiment of the present disclosure, a valve assembly 42 may be mounted to the first and second outlets 24, 25 and the first and second inlets 22, 23. In such an embodiment, the valve assemblies 42 may permit a proper flow of working fluid into and out of the first and second pumps 12, 16 while the pumps are in operation, but may prohibit a reverse flow of working fluid through the first and second inlets 22, 23 and outlets 24, 25.

In addition to the components already discussed, pump housing 10 may further include a dividing wall 20. As illustrated in FIG. 1, the dividing wall 20 may span the entire housing 10 so as to completely separate the first pumping assembly 13 from the second pumping assembly 15. It is understood that the dividing wall 20 may be a common wall, and may have a first side 48 and a second side 50. It is further understood that in an embodiment of the present disclosure, the dividing wall 20 may separate the pumps 12, 16 forming a barrier such that no working fluid may pass between the first pump 12 and second pump 16 while within the housing 10.

The dividing wall 20 may include at least two bearing bays 32. In such an embodiment, one of the bays 32 may be located on the first side 48 of the dividing wall 20 and one of the bays 32 may be located on the second side 50 of the dividing wall 20. Each bearing bay 32 may be machined, drilled or otherwise formed into the dividing wall 20 in order to house a bearing assembly 33 of the type commonly known in the art. The total number of bearing bays 32, and their location in the dividing wall 20, may depend on the type and number of pumps 12, 16 being located within the housing 10 and may relate to the number and location of driving shafts 52, 53 or driven shafts 38, 40 utilized by the pumping assemblies 13, 15.

It is further understood that the housing 10 may also include at least two bearing bays 32, one of the bays 32 being located in a first housing wall 34, and the other being located in a second housing wall 36 of the pump housing 10. The total number of bearing bays 32 in the housing 10, and their location therein, may depend on the type and number of pumps 12, 16 being located within the housing 10 and may relate to the number and location of first and second driven shafts 38, 40 utilized by the pumping assemblies 13, 15.

In an embodiment of the present disclosure, the first and second driven shafts 38, 40 may be rotatably connected to the bearing assemblies 33 housed by the bearing bays 32. In such an embodiment, the first and second driven shafts 38, 40 may rotate within the bearing assemblies 33 when a rotational force is applied to the shafts 38, 40. It is understood that in such an embodiment, other commonly known pumping assembly components such as, but not limited to, gears, vanes, and impellers may be fixedly mounted to the shafts 38, 40 and rotate therewith when a rotational driving force is applied thereto. Commonly known pumping assembly components such as, but not limited to, gears, vanes, and impellers may also be fixedly mounted to the driving shafts 52, 53 and rotate therewith.

Figure 2:
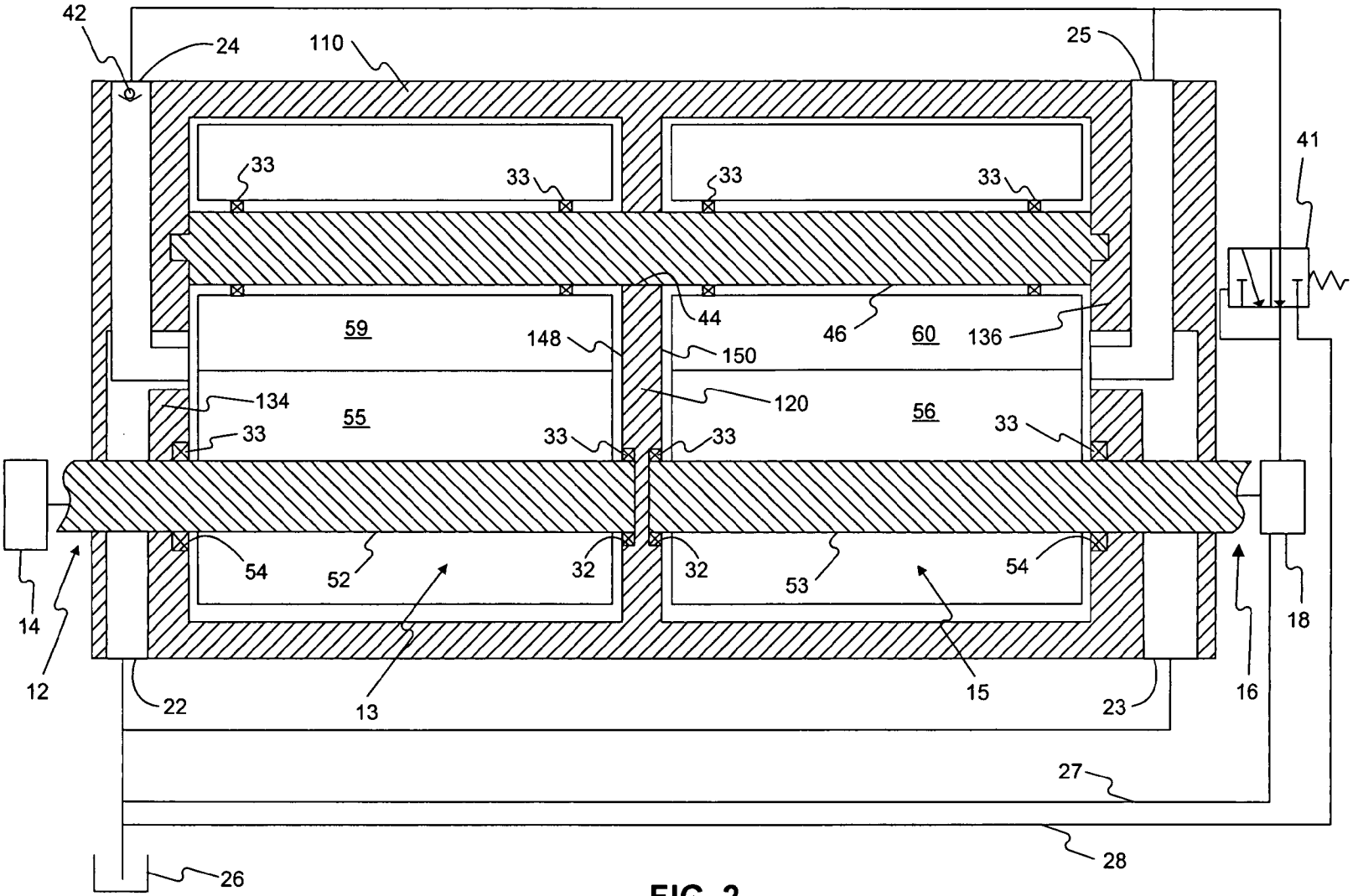
FIG. 2 is a partial cross section and partial diagrammatic view of a multiple pump housing according to another exemplary embodiment of the present disclosure.

FIG. 2 shows a pump housing 110 according to another embodiment of the present disclosure. The same reference numbers will be used in FIG. 2 to refer to like parts in FIG. 1.

In addition to the pumps 12, 16, inlets 22, 23, outlets 24, 25, valve assemblies 42, sump 26 and other components already discussed, the pump housing 110 may further include a dividing wall 120, a first housing wall 134 and a second housing wall 136. The dividing wall 120 may span the entire housing 110 and may include a thru hole 44. The housing 110 may further include a common shaft 46, one end being fixedly attached to the first housing wall 134 and the other end being fixedly attached to the second housing wall 136. The common shaft 46 may also pass through the thru hole 44 and be sealingly connected to the dividing wall 120. In this way, the common shaft 46 may operate as a stationary support shaft for both the first and second pumps 12, 16 in that components of both pumps 12, 16 such as, but not limited to, gears, impellers or vanes may be rotatably mounted to it. The dividing wall 120 may separate all elements of the first pump 12 from the second pump 16 with the exception of the common shaft 46.

The dividing wall 120 may be a common wall and may have a first side 148 and a second side 150. In an embodiment of the present disclosure, the dividing wall 120 forms a barrier such that no working fluid may pass between the first pump 12 and second pump 16 while within the housing 110. Accordingly, because the common shaft 46 is sealedly connected to the dividing wall 120, no fluid may pass through the thru hole 44.

The dividing wall 120 may include at least two bearing bays 32. In such an embodiment, one of the bays 32 may be located on the first side 148 of the dividing wall 120 and one of the bays 32 may be located on the second side 150 of the dividing wall 120. Each bearing bay 32 may be machined, drilled or otherwise formed into the dividing wall 120 in order to house a bearing assembly 33 of the type commonly known in the art. The bearing assemblies 33 may be of the appropriate size and type to accept a first or second driving shaft 52, 53 from the first or second drive assembly 14, 18. The total number of bearing bays 32 included in the dividing wall 120, and their location therein, may depend on the number and type of pumps 12, 16 utilized within the housing 110, and may correspond to the number of driving shafts 52, 53.

It is understood that due to the use of a fixedly mounted common shaft 46, first and second walls 134, 136 of the housing 110 may not require bearing bays 32. Instead, the aforementioned components of the first and second pumping assemblies 13, 15, including, but not limited to gears, impellers or vanes, may be rotatably mounted to the common shaft 46 using a number of appropriate bearing assemblies 33 or other similar structures.

INDUSTRIAL APPLICABILITY

As discussed above, the pump housing 10 encloses at least a portion of a first pump 12 and at least a portion of a second pump 16, and each pump 12, 16 includes a pumping assembly 13, 15 and a drive assembly 14, 18. The first and second pumping assemblies 13, 15 enclosed within the housing 10 are driven by separate first and second drive assemblies 14, 18. For example, and according to one embodiment of the present disclosure, the first drive assembly 14 may be an electric motor type drive assembly, and the second drive assembly 18 may be an internal combustion engine type drive assembly. Likewise, the first and second pumps 12, 16 may both be gear pumps. For ease of description, reference will be made to these particular types of drive assemblies and pumps for the remainder of the disclosure.

The first and second gear pumps 12, 16 draw working fluid from the sump 26 into the housing 10. The working fluid flows from the sump 26 into the housing 10 through the first and second inlets 22, 23. The fluid is drawn into the housing 10 as a result of a low pressure created by the motion of the rotors of the first and second pumping assemblies 13, 15. The fluid is then positively displaced by the pumping assemblies 13, 15 and is eventually forced through a first outlet 24, and a second outlet 25. After passing through a check valve 42, the fluid leaves the housing 10.

The working fluid then passes through a relief valve 41 and flows to the internal combustion engine 18 to lubricate and/or cool components of the engine. After being used by the internal combustion engine 18, the working fluid travels through an outlet line 27 and is supplied back to the sump 26.

Enclosing two gear pumps 12, 16 within a single housing 10 according to the present disclosure may have the advantage of conserving valuable space within an engine compartment. For instance, such a design may not require an oversized shaft capable of transmitting increased torque loads. It may also allow for the use of standard sized couplings, bearings, and other pump components. Constructing a multiple pump housing 10 to enclose at least a portion of a first and second gear pump 12, 16, as opposed to fabricating multiple separate housings, may also decrease the overall volume of engine compartment space required. Because less housing material may be required to enclose multiple pumps in a single housing, the present disclosure could also result in a decrease in fabrication costs.

In addition, providing a reduced flow gear pump 16 driven by an internal combustion engine 18, in combination with a gear pump 12 driven by an electric motor 14, may provide drive efficiency gains at high engine speeds. The working fluid requirements of an internal combustion engine 18 may gradually increase with RPM up to a point at which the engine 18 is operating at peak torque. At peak torque engine speed, the volume of working fluid the engine 18 requires may be approximately equal to a predetermined flow volume. At speeds faster than peak torque engine speed, the engine 18 continues to require the predetermined flow volume of working fluid regardless of whether the engine speed continues to increase. Thus, the quantity of working fluid required to lubricate and/or cool the components of the engine 18 remains relatively constant even when the engine 18 is operating at speeds greater than at peak engine torque.

By including an electric motor driven pump 12 along with a pump 16 driven by an internal combustion engine 18, the electric motor driven pump 12 may be much smaller. In addition, the electric motor driven pump 12 may supply working fluid to an internal combustion engine 18 prior to start up. The pumps 12, 16 may also supply working fluid to the internal combustion engine 18 at varying rates, based on a predetermined algorithm, throughout the internal combustion engine's entire RPM range up until peak torque engine speed is reached. Finally, it is further understood that the electric motor driven pump 12 of the present disclosure may also supply working fluid to the internal combustion engine 18 after the internal combustion engine 18 has stopped rotating.

Other embodiments of the disclosure will be apparent to those skilled in the art from consideration of the specification and practice of the invention disclosed herein. For example, the first and second pumps 12, 16 may draw working fluid from more than one sump 26. The housing 10, 110 may include more than one dividing wall 20, 120 separating the pumps 12, 16 within the housing 10, 110. As mentioned above, the housing 10, 110 may also have more than two inlets 22, 23 and more than two outlets 24, 25.

It is intended that the specification and examples be considered as exemplary only, with a true scope of the invention being indicated by the following claims.

What is claimed is:

1. A fluid delivery system, comprising:

a first pump including a first drive assembly;

a second pump including a second drive assembly;

a pump housing, at least a portion of each of the first and second pumps being located in the housing, the housing including at least one passageway fluidly connecting the first and second pumps, in parallel, to the second drive assembly; and a dividing wall separating the first pump from the second pump in the housing, the dividing wall including a bearing bay.

2. The system of claim 1, wherein the dividing wall further includes at least two bearing bays, at least one bearing bay located on a first side of the dividing wall and at least one bearing bay located on a second side of the dividing wall.

3. The system of claim 1, wherein the pump housing further includes a thru hole extending through the dividing wall, the thru hole being configured to receive a common shaft between the pumps.

4. The system of claim 1, wherein the first pump further includes a first rotatable driving shaft, and the second pump further includes a second rotatable driving shaft disconnected from the first rotatable driving shaft.

5. The system of claim 1, wherein the second drive assembly is of a different type than the first drive assembly.

6. The system of claim 5, wherein the second drive assembly is of the internal combustion engine type.

7. The system of claim 6, wherein the first drive assembly is of the electric motor type.

8. The system of claim 6, wherein the first and second pumps deliver working fluid to the second drive assembly.

9. The system of claim 1, wherein the housing further includes at least one valve assembly configured to control the flow of working fluid.

10. A fluid delivery system, comprising:

a first pump driven by an electric motor;

a second pump driven by an internal combustion engine;

a pump housing, at least a portion of each of the first and second pumps being enclosed within the housing, and a dividing wall completely separating the first pump from the second pump, the dividing wall being common to the first and second pumps and the dividing wall further including at least two bearing bays, at least one of the bearing bays being located on a first side of the dividing wall and at least one of the bearing bays being located on a second side of the dividing wall.

11. The system of claim 10, wherein the first and second pumps deliver working fluid to the internal combustion engine.

12. The system of claim 10, wherein the first pump includes a first rotatable driving shaft and the second pump includes a second rotatable driving shaft disconnected from the first rotatable driving shaft.

13. A method of supplying fluid, comprising:

driving a first pump with a first drive assembly, driving a second pump with a second drive assembly, supplying working fluid, in parallel, from the first and second pumps out of a common housing to the second drive assembly, the housing including a dividing wall separating the first pump from the second pump, the dividing wall including a bearing bay; and supporting a shaft of at least one of the first pump and the second pump in the bearing bay.

14. The method of claim 13, wherein the second drive assembly is of a different type than the first drive assembly.

15. The method of claim 14, wherein the second drive assembly includes an internal combustion engine drive assembly.

16. The method of claim 15, wherein the first drive assembly includes an electric motor drive assembly.

17. The method of claim 15, wherein the supplying of working fluid from the first and second pumps includes supplying working fluid to the internal combustion engine.

18. The method of claim 17, further comprising passing the working fluid supplied to the internal combustion engine to a sump, said sump supplying working fluid to the first and second pump.

19. The system of claim 2, wherein:

each of the first and second pumps includes a rotatable shaft;

an end of the rotatable shaft of the first pump is disposed within the bearing bay on the first side of the dividing wall; and an end of the rotatable shaft of the second pump is disposed within the bearing bay on the second side of the dividing wall.

20. The system of claim 10, wherein working fluid in the first pump is substantially isolated from working fluid in the second pump while within the housing.

21. The system of claim 6, further including an overpressure protection device fluidly connected to control a pressure of working fluid supplied to the internal combustion engine type drive assembly from the first and second pumps.

22. The system of claim 1, wherein the first and second pumps include a common shaft between the pumps, the common shaft including two ends, and each of the two ends of the common shaft is fixedly attached to the housing.

23. A fluid delivery system, comprising:

a first pump including a first drive assembly;

a second pump including a second drive assembly, the first and second pumps sharing a common shaft;

a pump housing, at least a portion of each of the first and second pumps being located in the housing, the housing including at least one inlet and at least one outlet allowing working fluid to enter and exit the housing;

a sump disposed outside the housing and fluidly connected to the at least one inlet of the housing;

a dividing wall separating the first pump from the second pump in the housing; and a thru hole extending through the dividing wall, the thru hole being configured to receive the common shaft between the pumps.

24. The system of claim 23, wherein working fluid is supplied in parallel to both of the first and second pumps from the sump.

25. The system of claim 24, wherein working fluid is supplied in parallel from both of the first and second pumps to the second drive assembly, and the second drive assembly supplies the working fluid to the sump.

26. The system of claim 23, wherein:

the at least one inlet of the housing includes a first inlet allowing working fluid to enter the first pump and a second inlet allowing working fluid to enter the second pump; and the at least one outlet of the housing includes a first outlet allowing working fluid to exit the first pump and a second outlet allowing working fluid to exit the second pump.

27. The system of claim 23, wherein the pump housing is located in an engine compartment.

28. The system of claim 23, wherein the housing includes two inlets and working fluid is supplied in parallel via the two inlets to both of the first and second pumps from the sump.

29. The system of claim 1, wherein:

at least one of the first and second pumps includes a rotatable shaft; and an end of the rotatable shaft is disposed within the bearing bay of the dividing wall.

30. The method of claim 13, wherein the supporting of the at least one shaft of the at least one of the first pump and the second pump includes:

supporting a common shaft of the first pump and the second pump in the bearing bay.

31. The method of claim 13, wherein:

the at least one shaft includes a first rotatable shaft of the first pump and a second rotatable shaft of the second pump;

the dividing wall includes a first bearing bay located on a first side of the dividing wall and a second bearing bay located on a second side of the dividing wall; and the supporting of the at least one shaft of the at least one of the first pump and the second pump includes:

supporting an end of the first rotatable shaft within the first bearing bay; and supporting an end of the second rotatable shaft within the second bearing bay.

32. The system of claim 23, wherein the common shaft includes two ends, and each of the two ends of the common shaft is fixedly attached to the housing.

* * * * *